US006460195B2

(12) United States Patent
Wang

(10) Patent No.: US 6,460,195 B2
(45) Date of Patent: Oct. 8, 2002

(54) HEALTH-ENHANCING SHORT TROUSERS HAVING BOTH MASSAGING AND HIP-LIFTING FUNCTIONS

(76) Inventor: Jun-Ming Wang, 1F, No. 39, Alley 23, Lane 687, Sec. 2, Ta Tung Rd., Taipei (TW)

( * ) Notice: Subject to any disclaimer, the term of this patent is extended or adjusted under 35 U.S.C. 154(b) by 0 days.

(21) Appl. No.: 09/990,275

(22) Filed: Nov. 23, 2001

(65) Prior Publication Data

US 2002/0062515 A1 May 30, 2002

(30) Foreign Application Priority Data

Jun. 15, 2001 (CN) ..... 00260471 U

(51) Int. Cl.[7] ..... A41D 13/00

(52) U.S. Cl. ..... 2/228; 2/227; 2/DIG. 3

(58) Field of Search ..... 2/227, 228, 238, 2/455, 456, DIG. 3; 602/2, 13, 60, 61, 53, 55, 67, 62, 58, 59; 606/201, 202, 204, 112; 601/1, 46, 55, 56, 57; 128/118.1, 96.1, 98.1; 441/120, 88, 99, 102, 108, 113

(56) References Cited

U.S. PATENT DOCUMENTS

| | | | | | |
|---|---|---|---|---|---|
| 3,589,366 | A | * | 6/1971 | Feather | 606/201 |
| 4,624,248 | A | * | 11/1986 | Poole et al. | 606/201 |
| 4,737,994 | A | * | 4/1988 | Galton | 2/455 |
| 5,514,155 | A | * | 5/1996 | Daneshvar | 606/201 |
| 6,231,411 | B1 | * | 5/2001 | Vinay | 441/120 |
| 6,328,627 | B1 | * | 12/2001 | Smith | 450/134 |
| 6,338,722 | B1 | * | 1/2002 | Barbe-Vicuna et al. | 602/62 |

* cited by examiner

*Primary Examiner*—Gloria M. Hale
(74) *Attorney, Agent, or Firm*—Rosenberg, Klein & Lee

(57) ABSTRACT

Health short trousers comprise a trouser body composed of a front and a rear cloths. A female buckling element is joined on a right cloth to be adjusted for joining a male buckling element on a left cloth. Two female buckling elements of a left and a right buckling bands are joined at crotch portions of two trouser legs of the rear cloth, respectively. Two male buckling elements of the left and right buckling bands are joined at crotch portions of two trouser legs of the front cloth, respectively. An upper air bag is joined at the trouser top in the trouser body. Lower air bags are joined at thigh portions in the trouser body. All the air bags are connected to an inflator having a control switch. A first vibrator is joined on the rear cloth. A second vibrator is joined on the front cloth.

10 Claims, 5 Drawing Sheets

HEALTH-ENHANCING SHORT TROUSERS HAVING BOTH MASSAGING AND HIP-LIFTING FUNCTIONS

FIELD OF THE INVENTION

The present invention relates to health-enhancing short trousers having both massaging and hip-lifting functions and, more particularly, to short trousers having an air-pressure type massaging function employing periodic inflation and deflation of air bags and a vibration type massaging function employing vibrators to massage the waist and thigh portions of the wearer's body and to generate a hip-lifting effect.

BACKGROUND OF THE INVENTION

Along with development of business and enhancement of living conditions and increase of individual incomes, the opportunities to exercise have decreased. Nowadays, people are increasingly more attentive to the health of themselves and of their kith and kin, and therefore seek more opportunities to exercise indoors for short periods of time. Therefore, various kinds of bodybuilding apparatuses having massaging effect that can be conveniently used indoors have been continually introduced. Among the bodybuilding apparatuses, a waist-astringent air pressure massager utilizes an inflator to generate a pumping and releasing effect to air bags so as to simulate the actions of pressing the body with hands, thereby generating a massaging effect upon the user's waist and back regions. However, the massager can only be applied to the waist, hence only having limited utility. The present invention aims to resolve the above problem.

SUMMARY OF THE INVENTION

One object of the present invention is to provide health-enhancing short trousers having both massaging and hip-lifting functions, which comprise a trouser body capable of being easily astringed upon users of different builds. The health-enhancing short trousers can be quickly worn about a user's waist like common short trousers are worn. The health-enhancing short trousers are equipped with air bags therein. With the air bags coupled to an inflator, the air bags can be inflated and deflated in a periodic way so as to generate an air pressure type massaging function.

Another object of the present invention is to provide health-enhancing short trousers having both massaging and hip-lifting functions, whereby pumping and releasing massaging effects are simultaneously generated at the thigh and waist portions of the user so as to enhance circulation and produce other healthy effects from the user's waist portion to thigh portion. Moreover, vibrators are disposed at the lower part of the abdomen corresponding to the navel and the perineum to perform vibration type massaging of these two important areas. The vibration type massage can complement the air-pressure type massage.

To achieve the above objects, the health-enhancing short trousers of the present invention comprise a trouser body composed of a front cloth and a rear cloth. The front and rear cloths are joined together to form short trousers. A female buckling element of a buckling band is joined on a right cloth situated at the half joint position of the front cloth. The female buckling element of the buckling band can be adjusted to join a male buckling element of the buckling band disposed on the outer surface of the joint position of a left cloth. A female buckling element of a left buckling band and a female buckling element of a right buckling band are joined at crotch portions of two trouser legs of the rear cloth, respectively. A male buckling element of the left buckling band and a male buckling element of the right buckling band are joined at crotch portions of two trouser legs of the front cloth, respectively. The female buckling elements of the left and right buckling bands can be fixed with the male buckling elements of the left and right buckling bands from inside to outside. An upper air bag is joined at the trouser top in the trouser body. Lower air bags are joined at the thigh portions in the trouser body. All the air bags are connected to an inflator having a control switch. A first vibrator is joined at the crotch portions of the rear cloth. A second vibrator is joined at the middle portion of the trouser top of the front cloth.

BRIEF DESCRIPTION OF THE DRAWINGS

The various objects and advantages of the present invention will be more readily understood from the following detailed description when read in conjunction with the appended drawings, in which.

DETAILED DESCRIPTION OF THE PREFERRED EMBODIMENTS

Figure 1:
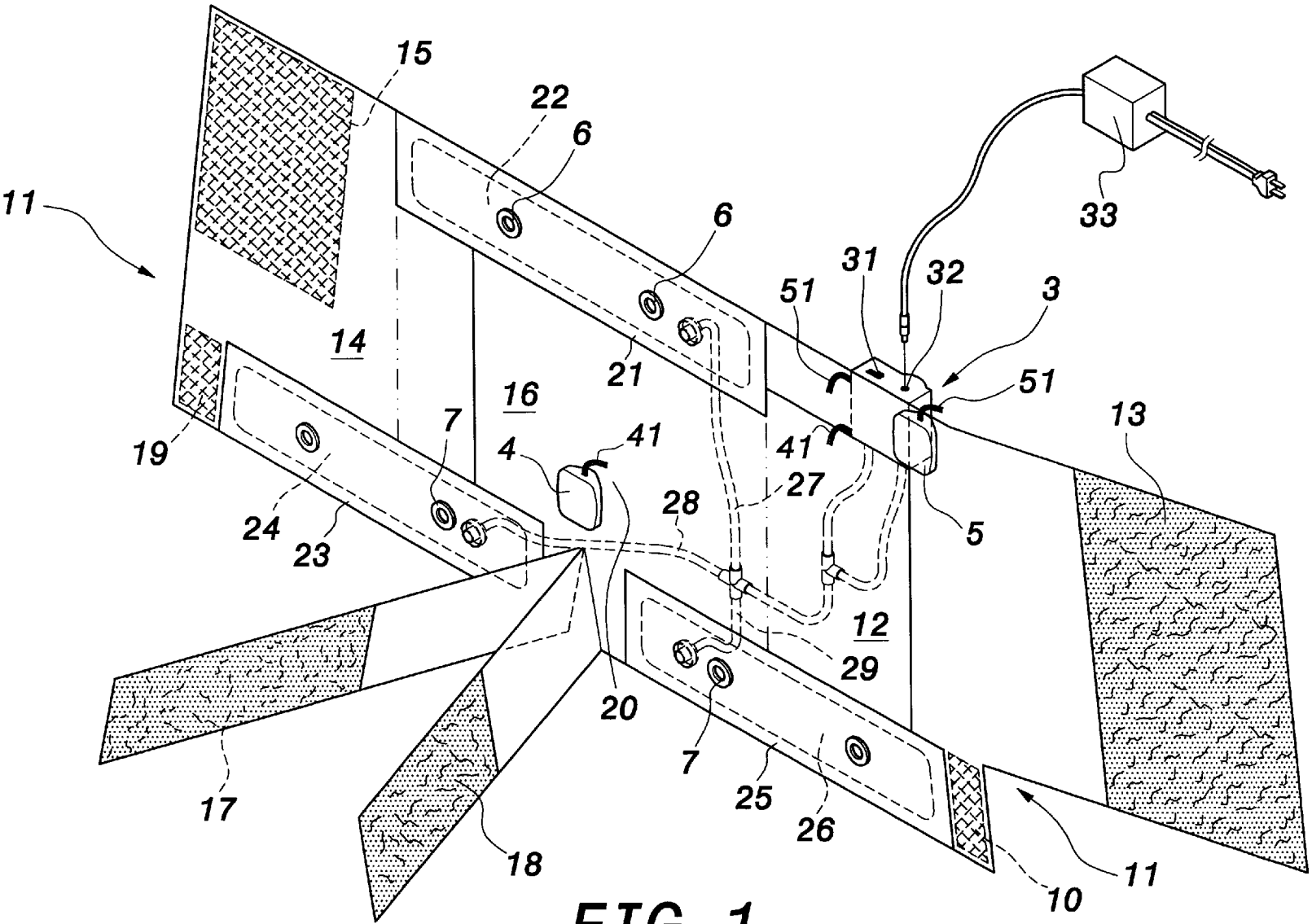
FIG. 1 is an unfolded perspective view of one embodiment of the present invention.

As shown in FIGS. 1 to 5, the subject health-enhancing short trousers having both massaging and hip-lifting functions of the present invention comprise a trouser body 1 composed of a front cloth 11 and a rear cloth 16, which are joined together to form short trousers. The left and right sides mentioned below are referenced with respect to FIG. 1. The front cloth 11 includes a right cloth 12 and a left cloth 14. Two ends of the front cloth 11 are directly joined with the rear cloth 16, as the dashed lines show in FIG. 1. A female buckling element 13 of a buckling band is joined to the right cloth 12 situated at a half joint position of the front cloth 11. The female buckling element 13 of the buckling band can be adjusted to join a male buckling element 15 of the buckling band disposed on the outer surface of the joint position of the left cloth 14. A female buckling element 17 of a left buckling band, and a female buckling element 18 of a right buckling band are joined at crotch portions of two trouser legs at the lower ends of the rear cloth 16, respectively. A male buckling element 19 of the left buckling band and a male buckling element 10 of a right buckling band are joined at crotch portions of two trouser legs at the lower ends of the front cloth 11, respectively. The female buckling elements 17 and 18 of the left and right buckling bands can be fixed with the male buckling elements 19 and 10 of the left and right buckling bands from the inside to the outside. The female buckling elements can be originally positioned for positioning the male buckling elements with respect thereto, and vice versa.

An upper air bag 22 is joined at a trouser top 21 in the trouser body 1. The upper air bag 22 can be situated at a region of the rear cloth 16 or may extend from the rear cloth 16 to the front cloth 11. Because the upper air bag 22 may either astringe the user's entire waistline or a smaller portion of the waistline, the upper air bag 22 is not limited in length. A plurality of magnetic rings 6 are alternately disposed on the outer surface of the inside of the upper air bag 22. Lower air bags 24 and 16 are joined at left and right thigh portions 23 and 25 in the trouser body 1, respectively. The air bags 22, 24, and 26 are connected to an inflator 3 via connection pipes 27, 28, and 29, respectively. The connection pipes 27, 28, and 29 are disposed at stiffeners of the trouser body 1. An inner liner is joined on the inner face of the rear cloth 16 to provide the user more comfort when worn. A control circuit is disposed in the inflator 3, and a control switch 31 and a power source receptacle 32 are disposed on the outer surface of the inflator 3. The power source receptacle 32 is connected to an AC power source 33. The control switch 31 can be a multi-section adjustment rod, or a thin-film push-button. The control switch 31 is used to control the inflation and deflation time of the inflator 3, and some specific modes thereof are provided for selection. A first vibrator 4 is joined in a stiffener of the inner face at the crotch portion 20 of the rear cloth 16. A second vibrator 5 is joined at the middle portion of the inner face of the trouser top 21 of the front cloth 11 (i.e., in a stiffener of the right cloth 12 corresponding to the side of the inflator 3). The vibrators 4 and 5 are connected to the inflator 3 via electric wires 41 and 51 to jointly access the power source of he inflator 3. The vibrators 4 and 5 can be controlled by the switch 31 to start vibrating or stop vibrating. Vibration of the vibrators and inflation of the air bags may be operated simultaneously. Inflation of the air bags by the inflator 3 may also be operated separately, with the vibrators turned off.

Figure 2:
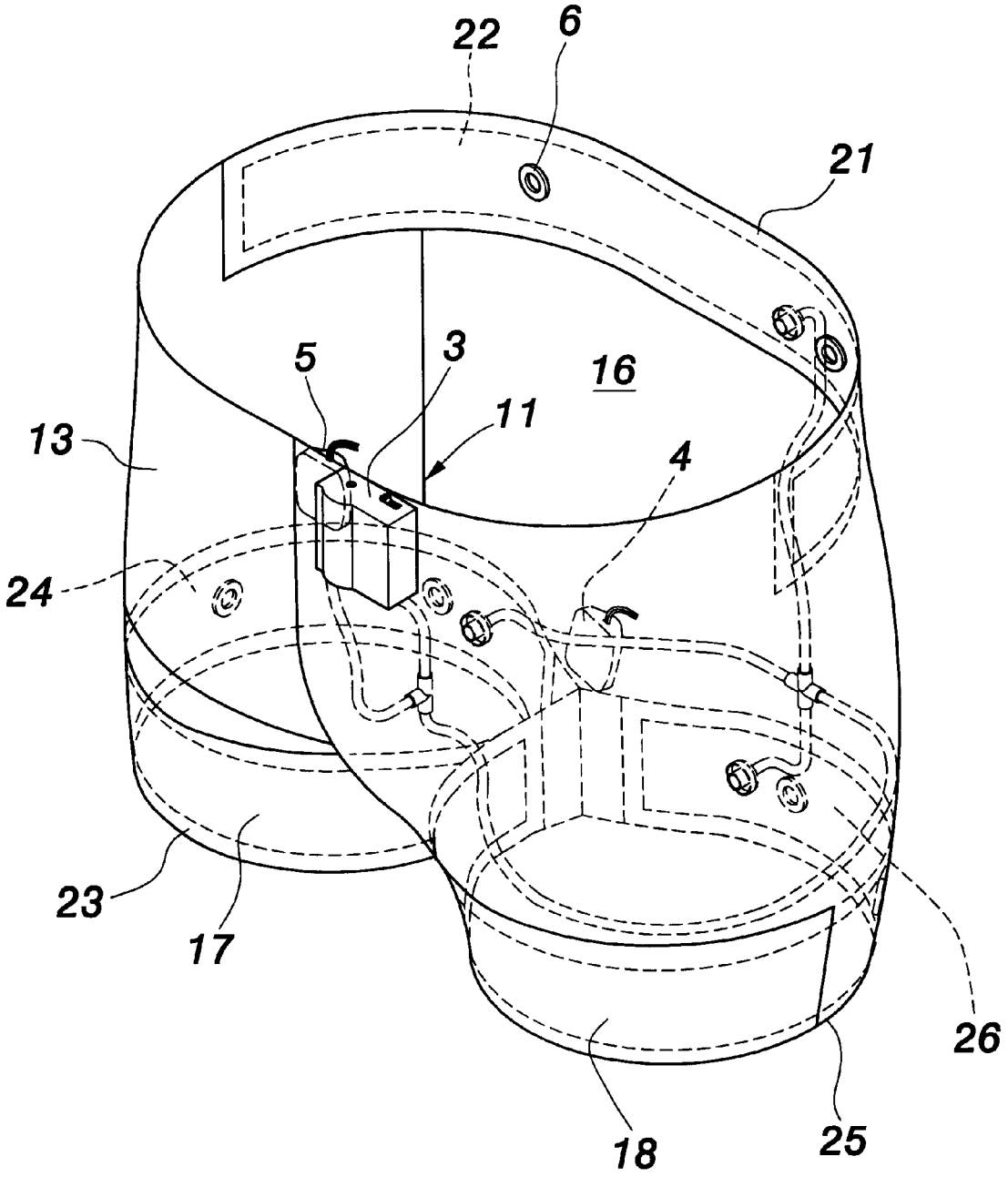
FIG. 2 is a perspective view of one embodiment of the present invention.
Figure 3:
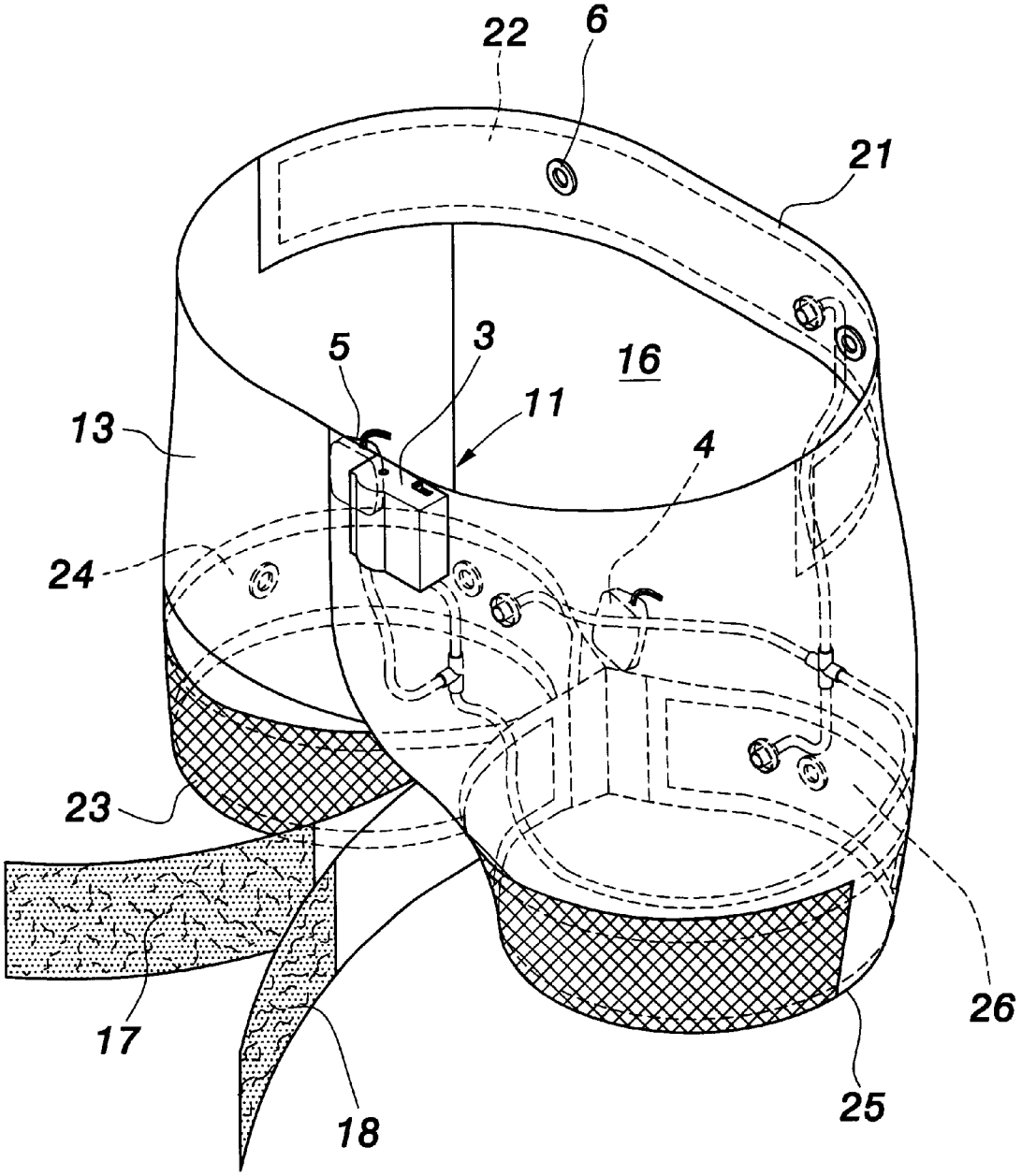
FIG. 3 is a perspective view of one embodiment of the present invention before certain components are joined together.

In the present invention, a trouser body may be slipped on to the user's waist like a skirt. If the user is right-handed, the user may use the left hand to buckle the female buckling element 13 of a buckling band of the right cloth 12 with the male buckling element 15 of a buckling band of the left cloth 14. Because the present embodiment of the invention is wide enough, the degree of its astringency can be freely adjusted. Because the present invention relates to short trousers, the trouser legs thereof are very near the roots of thighs. In other words, the short trousers nestle up against the hip. When the female buckling elements 17 and 18 on the rear cloth 16 protrude forward and then are wound outwards, as shown in FIG. 3, the male buckling elements 19 and 10 will be situated during use as shown in FIG. 2.

Figure 4:
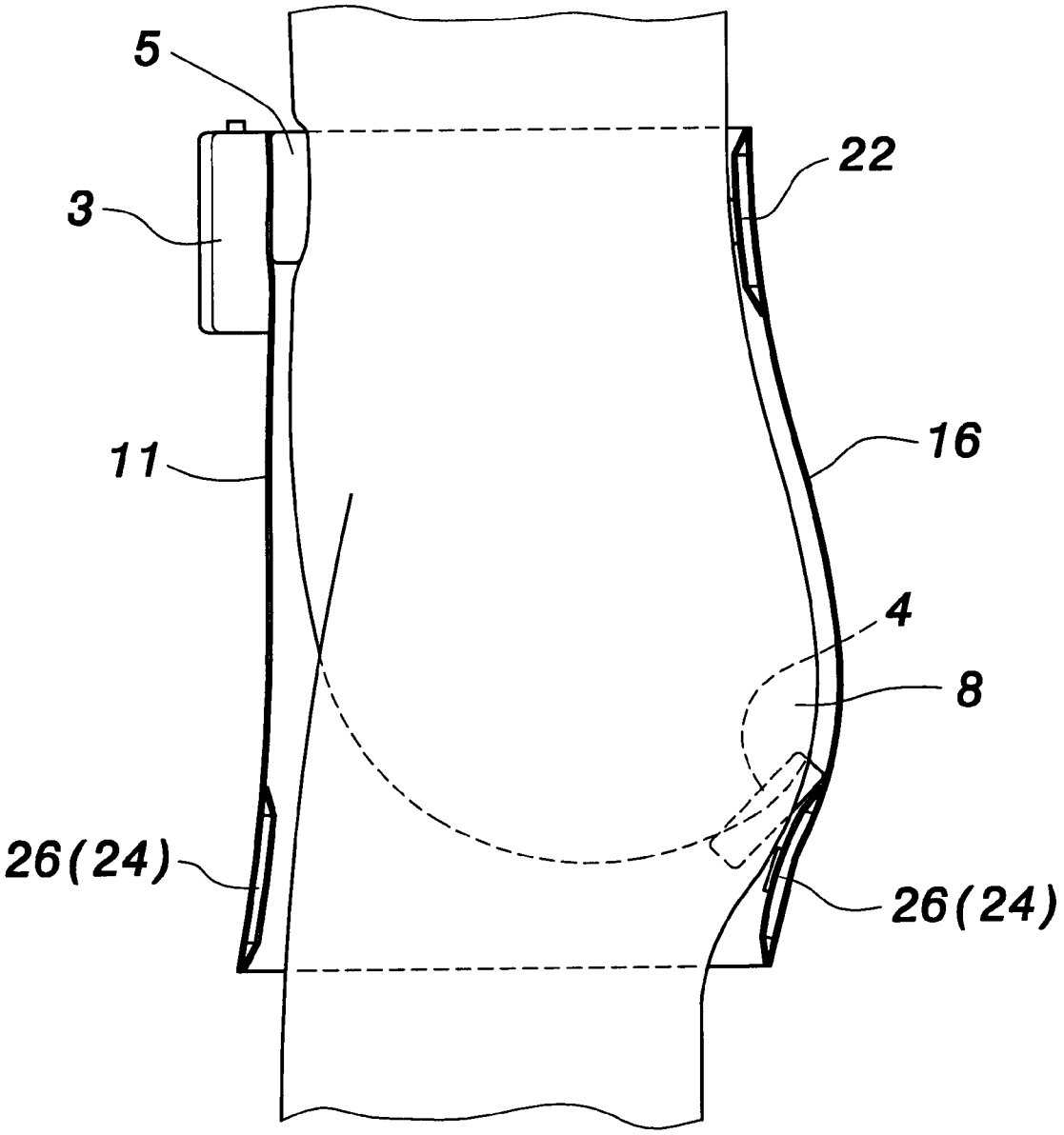
FIG. 4 is a cross-sectional view of one embodiment of the present invention after being worn; and, FIG. 5 is a side view of the embodiment of the present invention shown in FIG. 4 during use.
Figure 5:
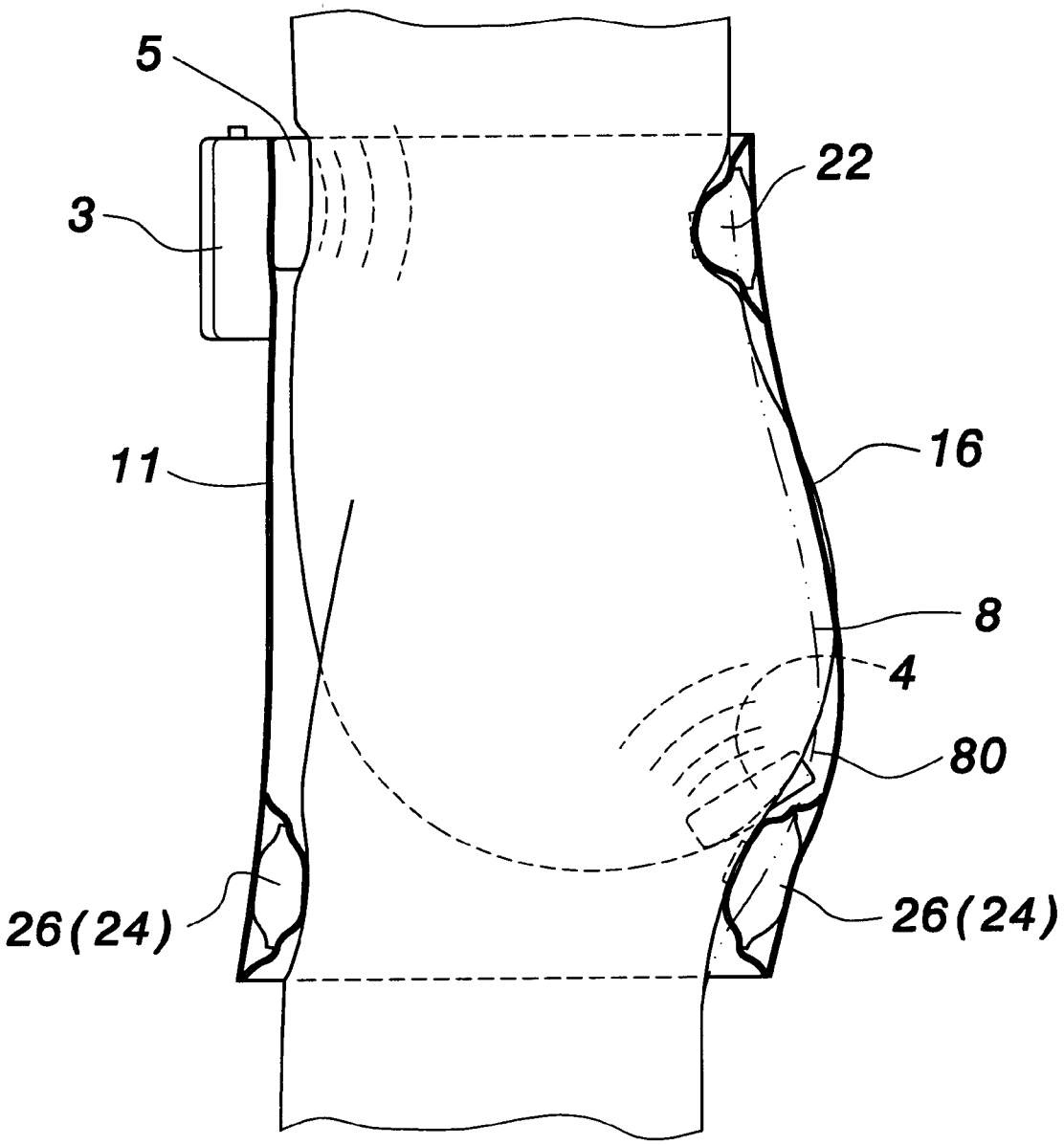

FIG. 4 shows the short trousers worn for use on the human body. When the inflator 3 is activated, it will continually output air to let the air bags 22, 24, and 26 expand simultaneously so as to compress the human boy, as shown in FIG. 5. Thereby, an original contour 8 of the human body will be astringed to a contour 80 upon being acted on by the air bags. The muscles of the hip will be compressed upwards, hence naturally generating hip-lifting effect. Owing to the exercise the hip muscles, circulation within the user's body will be enhanced. Because the user's large and small intestines connected to the anus are located with the hip region, the user's digestive tract functions can also be enhanced. In addition, muscles from the waist to the thighs can be massaged. Upon inflation and deflation of the air bags, a compressed feel will be generated for the use. If vibration of the vibrators 4 and 5 is also correspondingly effected, oscillating actions will be generated at the lower pat of the abdomen and the perineum, and the air bags will be jointly caused to vibrate for further enhancing the massaging effect. Additionally, a plurality of magnetic rings are disposed on the inner faces of the air bags to generate magnetic effects. The present invention can thus provide better usage when compared to the prior art.

Although the present invention has been described with reference to the preferred embodiment thereof, it will be understood that the invention is not limited to the details thereof. Various substitutions and modifications have been suggested in the foregoing description, and others will occur to those of ordinary skill in the art. Therefore, all such substitutions and modifications are intended to be embraced within the scope of the invention as defined in the appended claims.

I claim:

1. Health short trousers having both massaging and hip-lifting functions, comprising:

a trouser body including a front cloth and a rear cloth, said front and said rear cloths being joined to form at least a portion of short trousers, said front cloth having a middle joint position thereof delineating a right cloth and a left cloth, a female buckling element of a buckling band being joined on said right cloth to be adjusted for joining a male buckling element of the buckling band disposed on an outer surface of a joint position of said left cloth, a female buckling element of a left buckling band and a female buckling element of a right buckling band being respectively joined at crotch portions of two trouser legs at lower ends of said rear cloth, a male buckling element of said left buckling band and a male buckling element of said right buckling band being respectively joined at trouser legs at lower ends of said left cloth and said right cloth, said female buckling elements of said left and right buckling bands being fixed with said male buckling elements of said left and right buckling bands;

an upper air bag joined to a trouser top of said rear cloth of said trouser body;

a pair of lower air bags respectively joined to thigh portions of said trouser body;

an inflator connected to said upper and lower air bags respectively via connection pipes, said connection pipes extending along said trouser body, said inflator being used to alternatively inflate and deflate said air bags, said inflator having a control switch, said inflator being fixed at a joint portion near said right cloth; and a first vibrator joined at a crotch portion of said rear cloth and a second vibrator joined at a middle portion of the trouser top of said front cloth.

2. The health short trousers having both massaging and hip-lifting functions as claimed in claim 1, wherein a plurality of magnetic rings are alternately joined on an outer surface of an inner side of said upper air bag.

3. The health short trousers having both massaging and hip-lifting functions as claimed in claim 1, wherein a plurality of magnetic rings are alternately joined on an outer surface of an inner side of each of said lower air bags.

4. The health short trousers having both massaging and hip-lifting functions as claimed in claim 1, wherein said vibrators are connected to said inflator via electric wires.

5. The health short trousers having both massaging and hip-lifting functions as claimed in claim 1, wherein said vibrators can vibrate separately or together.

6. A health short trousers having both massaging and hip-lifting functions, comprising:

a trouser body including a front cloth and a rear cloth, said front and said rear cloths being joined to form at least a portion of short trousers, said front cloth having a middle joint position thereof delineating a right cloth and a left cloth, a male buckling element of a buckling band being joined on said right cloth to be adjusted for joining a female buckling element of the buckling band disposed on an outer surface of a joint position of said left cloth, a male buckling element of a left buckling band and a male buckling element of a right buckling band being respectively joined at crotch portions of two trouser legs at lower ends of said rear cloth, a female buckling element of said left buckling band and a female buckling element of said right buckling band being respectively joined at trouser legs at lower ends of said left cloth and said right cloth, said male buckling elements of said left and right buckling bands being fixed with said female buckling elements of said left and right buckling bands;

an upper air bag joined to a trouser top of said rear cloth of said trouser body;

a pair of lower air bags respectively joined to thigh portions of said trouser body;

an inflator connected to said upper and lower air bags respectively via connection pipes, said connection pipes extending along said trouser body, said inflator being used to alternatively inflate and deflate said air bags, said inflator having a control switch, said inflator being fixed at a joint portion near said right cloth; and a first vibrator joined at a crotch portion of said rear cloth and a second vibrator joined at a middle portion of the trouser top of said front cloth.

7. The health short trousers having both massaging and hip-lifting functions as claimed in claim 6, wherein a plurality of magnetic rings are alternately joined on an outer surface of an inner side of said upper air bag.

8. The health short trousers having both massaging and hip-lifting functions as claimed in claim 6, wherein a plurality of magnetic rings are alternately joined on an outer surface of an inner side of each of said lower air bags.

9. The health short trousers having both massaging and hip-lifting functions as claimed in claim 6, wherein said vibrators are connected to said inflator via electric wires.

10. The health short trousers having both massaging and hip-lifting functions as claimed in claim 6, wherein said vibrators can vibrate separately or together.

* * * * *